US009907370B2

(12) United States Patent
Huddleston

(10) Patent No.: US 9,907,370 B2
(45) Date of Patent: Mar. 6, 2018

(54) COLLAPSIBLE CANOPY APPARATUS

(71) Applicant: Julia Annice Huddleston, Saltillo, MS (US)

(72) Inventor: Julia Annice Huddleston, Saltillo, MS (US)

( * ) Notice: Subject to any disclaimer, the term of this patent is extended or adjusted under 35 U.S.C. 154(b) by 0 days.

(21) Appl. No.: 15/423,185

(22) Filed: Feb. 2, 2017

(65) Prior Publication Data

US 2017/0215534 A1 Aug. 3, 2017

Related U.S. Application Data

(60) Provisional application No. 62/290,124, filed on Feb. 2, 2016.

(51) Int. Cl.

| | |
|---|---|
| ***A45B 11/02*** | (2006.01) |
| ***A45B 11/04*** | (2006.01) |
| *A45B 23/00* | (2006.01) |

(52) U.S. Cl.

CPC ..... *A45B 11/04* (2013.01); *A45B 11/02* (2013.01); *A45B 23/00* (2013.01); *A45B 2023/0006* (2013.01); *A45B 2023/0093* (2013.01)

(58) Field of Classification Search

CPC . A45B 11/04; A45B 25/02; A45B 2200/1009; A45B 2023/0006; A45B 23/00; A45B 11/02; A45B 2023/0093; A45F 3/14; A45F 2003/003; A45F 2003/146; A45F 2003/144

USPC ..... 224/186

See application file for complete search history.

(56) References Cited

U.S. PATENT DOCUMENTS

| | | | | | |
|---|---|---|---|---|---|
| 176,675 | A * | 4/1876 | Palmieri | A45B 11/02 | 135/137 |
| 753,107 | A * | 2/1904 | Pinchback | A45B 11/02 | 224/187 |
| 1,217,542 | A * | 2/1917 | Washington | A45B 11/02 | 224/187 |
| 1,368,516 | A * | 2/1921 | McCourt | A45B 11/02 | 224/189 |
| 1,469,111 | A * | 9/1923 | Russell | A45B 11/02 | 135/87 |
| 1,803,538 | A * | 5/1931 | Pistole | A45B 11/02 | 135/123 |
| 1,888,909 | A * | 11/1932 | Crosthwait | A45B 11/02 | 135/115 |

(Continued)

*Primary Examiner* — Adam Waggenspack
*Assistant Examiner* — Lester L Vanterpool
(74) *Attorney, Agent, or Firm* — Baker and Rannells, PA

(57) ABSTRACT

A collapsible canopy apparatus is provided. The apparatus includes a canopy mounted onto a collapsible frame. The frame includes flexible and resilient spring members that are biased in an upright position. The spring members include arcuate regions that define the arcuate shape of the frame. The spring members are interconnected at flex points that enable the spring members to fold relative to one another by twisting and bending actions. These actions enable a user to collapse the frame into a folded, storable configuration. A harness disposed in an interior of the canopy includes a waistband and shoulder straps for enabling a user to fasten the canopy to his or her torso and suspend the canopy therefrom. The shoulder straps include fasteners configured to removably attach to the interior of the canopy. Slide ribs disposed on an interior of the canopy enable vertical adjustment of the waistband.

17 Claims, 6 Drawing Sheets

(56) References Cited

U.S. PATENT DOCUMENTS 2,132,556 A * 10/1938 Blackshaw ..... A47D 15/006 297/484
2,434,526 A * 1/1948 Thornton ..... A45B 11/02 135/16
3,004,519 A * 10/1961 Weissman ..... A47D 15/006 119/857
3,448,826 A * 6/1969 Rosenblum ..... A62B 35/0012 182/3
3,802,451 A * 4/1974 Morris ..... A45B 19/02 135/20.2
3,951,160 A * 4/1976 Nitu ..... A45B 11/02 135/20.2
4,203,457 A * 5/1980 Friedman ..... A45B 11/02 135/33.7
4,226,474 A * 10/1980 Rupert ..... B60R 22/105 297/465
4,502,157 A * 3/1985 Wong ..... A41D 13/1153 2/1
D359,614 S * 6/1995 Bauman ..... D3/6
5,664,844 A * 9/1997 Greene ..... A47D 15/006 119/770
5,896,590 A * 4/1999 Fleisch ..... A42B 3/322 2/410
5,961,014 A * 10/1999 Knerr ..... A45F 3/04 224/153
6,009,839 A * 1/2000 Kohn ..... A47D 13/086 119/770
6,024,264 A * 2/2000 Java ..... A45B 3/00 135/16
8,015,619 B2 * 9/2011 McKay ..... A62B 35/0006 2/69
8,418,899 B1 * 4/2013 Stamps ..... A45F 3/14 224/251
8,944,300 B1 * 2/2015 Kaufman ..... A45B 11/02 135/16
2005/0279396 A1 * 12/2005 Choi ..... A45B 11/04 135/133
2006/0219279 A1 * 10/2006 Kaufman ..... A45B 11/02 135/20.1
2007/0262103 A1 11/2007 Blakley et al.
2008/0224460 A1 * 9/2008 Erez ..... A63B 69/0059 280/801.1
2010/0313922 A1 * 12/2010 Raider ..... A45B 11/02 135/16

* cited by examiner

COLLAPSIBLE CANOPY APPARATUS

CROSS REFERENCE TO RELATED APPLICATIONS

This application claims the benefit of U.S. Provisional Application No. 62/290,124 filed on Feb. 2, 2016. The above identified patent application is herein incorporated by reference in its entirety to provide continuity of disclosure.

BACKGROUND OF THE INVENTION

The present invention relates to canopies, hoods, and/or umbrellas. More specifically, the present invention relates to a flexible water resistant canopy having a collapsible frame and a harness for suspending the canopy around a user's body and securing it to a user's waist, thereby allowing the user to have the availability of the canopy at all times without requiring the user to use his or her hands to hold the canopy in position.

Portable canopies such as umbrellas are well known around the world. They are used outdoors when weather conditions are poor and people want to prevent the elements, such as rain, snow, and sleet from falling on them and soaking their clothes. Further, canopies are also widely used to block the sun.

Canopies come in a variety of shapes and sizes. However, a common feature is that they need to be affixed to a surface or held by the user when in use. Even when not in use and there is a threat of inclement weather, an umbrella, for example, must be carried either by hand or in a carry case of some sort. This deficiency makes it nearly impossible and potentially dangerous for the user to use the standard umbrella when performing activities that require two hands, such as riding a bicycle or carrying a large package. Additionally, holding a standard umbrella up for long periods of time can be tiring, such as when attending a sporting event that is taking place in the rain. These events can go on for prolonged periods of time, which may be too long to have to hold an umbrella in its normal upright, in-use position.

Canopies are also commonly known to fail in strong, windy conditions. For example, large canopies are often dislodged from the ground and driven or flown away by the wind and the majority of umbrellas are driven to invert. This problem occurs with any size canopy or umbrella due to the structures acting as sails.

The present invention is directed to overcoming these problems associated with traditional canopies and umbrellas and can be used in all weather conditions.

SUMMARY OF THE INVENTION

In view of the foregoing disadvantages inherent in the known types of canopies now present in the prior art, the present invention provides a collapsible canopy apparatus wherein the same can be utilized for providing convenience for the user when outdoors in inclement weather. The present invention comprises a canopy including a harness that is mounted onto a collapsible frame. The frame includes one or more spring members composed of a flexible and resilient material, which bias the frame in an upright position. The one or more spring members interconnect and intersect at flex points and are configured to flex about the flex points relative to one another into a folded configuration. The canopy includes a front end having a longitudinal face and a bottom end having a horizontal face, and an interior volume. An opening extending along the longitudinal face and the horizontal face provides access to the interior volume. The harness is disposed in the interior volume and includes a waistband and shoulder straps. The interior volume includes a lower end, a rear wall, and a pair of opposing sidewalls. The waistband is positioned annularly about the lower end. The shoulder straps include a fastener for removably attaching the shoulder straps to the opposing sidewalls and rear wall to suspend them therefrom.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
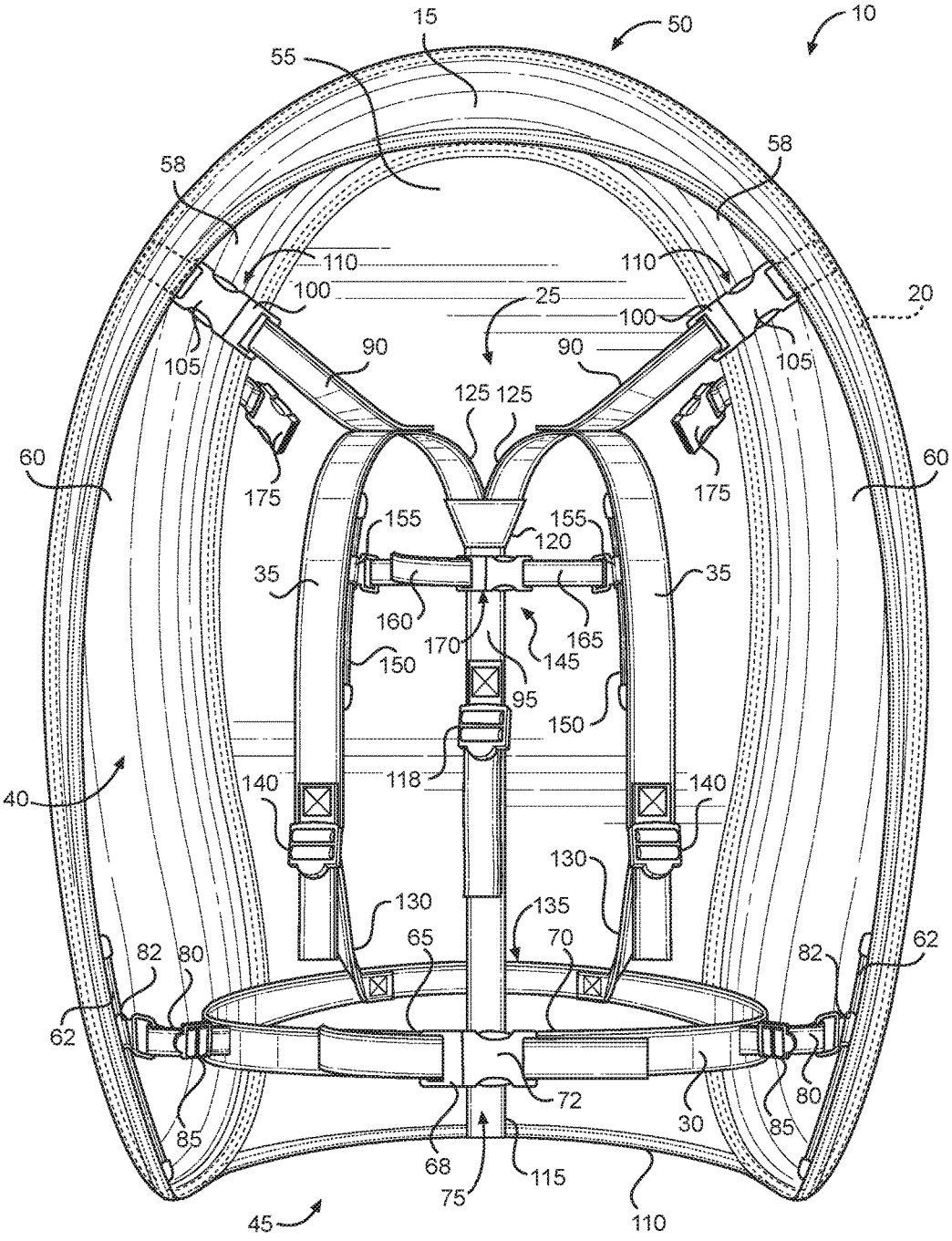
FIG. 1 shows a front view of the collapsible canopy apparatus.

Reference is made herein to the attached drawings. Like reference numerals are used throughout the drawings to depict like or similar elements of the collapsible canopy apparatus. The figures are intended for representative purposes only and should not be considered to be limiting in any respect.

Referring now to FIG. 1, there is shown a front view of the collapsible canopy apparatus. The present invention provides a collapsible canopy apparatus 10 comprising a canopy 15 mounted onto a frame 20 that is collapsible into a folded and storable configuration. The collapsible canopy apparatus 10 comprises a harness 25 including an adjustable waistband 30 and adjustable shoulder straps 35 for fastening the canopy apparatus 10 to a user's waist and suspending the canopy 15 around a user's body, in order to surround the torso and provide the user protection from the elements.

The harness 25 is disposed in an interior volume 40 of the canopy 15. The interior volume 40 includes a lower end 45, an upper end 50, a rear wall 55, and a pair of opposing sidewalls 60. The pair of opposing sidewalls 60 merge into the upper end 50 at curved portions 58. The waistband 30 is disposed in the interior volume 40 and is positioned annularly about the lower end 45 thereof. The waistband 30 comprises a unitary strap having a fastener, such as side release buckle for removably attaching the waistband 30 to a user's waist. In the depicted embodiment, the waistband includes a first end 65 and a second end 70 having complimentary mating fasteners for removably fastening to one another. In the depicted embodiment, the first end 65 and second end 70 conjunctively form an adjustable side release buckle 75, wherein the first end 65 includes the male mating portion 68 of the side release buckle 75 and the second end 70 includes the female mating portion 72 of the side release buckle 75. In this way, a user may don the waistband 30 around his or her waist and adjust the tightness of the waistband 30 therearound as desired.

The waistband 30 is suspended annularly about the lower end 45 of the canopy via a pair of lateral adjustment straps 80. The pair of lateral adjustment straps 80 are affixed to the sides of the waistband 30 and extend radially outwardly relative to the waistband 30 towards the pair of opposing sidewalls 60. The pair of lateral adjustment straps 80 connect the waistband 30 to the pair of opposing sidewalls 60 via slide ribs 62 that extend longitudinally along the pair of opposing sidewalls 60. The slide ribs 62 include elongated rod-like members protruding from the pair of opposing sidewalls 60. The pair of lateral adjustment straps 80 include side connectors 82 that are slidably disposed along the slide ribs 62. The slide connectors 82 are configured to adjust vertically along the length of the slide ribs 62, so as to enable a user to adjust the height of the waistband relative to a user. The pair of lateral adjustment straps 80 include strap adjusters 85 for extending and shortening the linear length of the pair of lateral adjustment straps 80 and thereby adjusting the proximity of the pair of opposing sidewalls 60 relative to the waistband 30. In this way, a user can adjust the closeness of the pair of opposing sidewalls 60 to his or her torso when the collapsible canopy apparatus 10 is donned.

The shoulder straps 35 are suspended in the interior volume 40 by auxiliary straps 90 and a support member 95. The auxiliary straps 90 include a unitary piece of material extending outwardly at an angle relative to the shoulder straps 35. The auxiliary straps 90 are disposed along the length of the shoulder straps 35. The auxiliary straps 90 include a fastener 100 disposed on a distal end thereof for removably attaching the shoulder straps 35 to a first pair of complimentary mating fasteners 105 that are disposed on the pair of opposing sidewalls 60. In the depicted embodiment, the fasteners 100 and the first pair of complimentary mating fasteners 105 conjunctively form adjustable side release buckles 110, wherein the fasteners 100 include the male mating portion of the side release buckle 110 and the first pair of complimentary mating fasteners 105 include the female rating portion of the side release buckle 110, such that the fasteners 100, 105 may secure the auxiliary straps 90 to the pair of opposing sidewalls 60.

The support member 95 includes a unitary piece of material extending longitudinally from the shoulder straps 35, through an interior of the waistband 30, to a perimeter edge 110 of the lower end 45 of the canopy 15. A first end 115 of the support member 95 is affixed to the perimeter edge 110 and a second end 120 is affixed to the shoulder straps 35. The support member 95 includes a strap adjuster 118 for adjusting the distance between the shoulder straps 35 and the lower end 45, or the height at which the shoulder straps 35 are suspended in the interior volume 40. The strap adjuster 118 further adjusts the distance of the upper end 50 relative to the lower end 45, thereby enabling a user to adjust the proximity of the upper end 50 to his head when the collapsible canopy apparatus 10 is donned.

The shoulder straps 35 include a first end 125 affixed to the second end 120 of the support member 95 and a second end 130 affixed to a rear portion 135 of the waistband 30. The shoulder straps 35 include strap adjusters 140 disposed along a linear length thereof for adjusting vertical height of the shoulder straps 35 relative to the waistband 30, thereby enabling a user to adjust the tightness of the shoulder straps 30 around a user's shoulder and back.

A height adjustable cross strap 145 interconnects the shoulder straps 35 to one another across a user's sternum or chest. The cross strap 145 is connected to the shoulder straps 35 via slide ribs 150 disposed longitudinally along the shoulder straps 35. The slide ribs 150 include raised edges protruding outwardly from the shoulder straps 35. The cross strap 145 extends perpendicularly relative to the shoulder straps 35 and includes slide connectors 155 slidably disposed along the length of the slide ribs 150. The cross strap 145 includes a first portion 160 including a male fastener and a second portion 165 including a complimentary female fastener that conjunctively form an adjustable side release buckle 170 for removably releasing the cross straps 145 and the shoulder straps 35 from one another.

The rear wall 55 includes a second pair of complimentary fasteners 175 for receiving the fasteners 100 of the auxiliary straps 90. The second pair of complimentary mating fasteners 175 are aligned with the first pair of complimentary mating fasteners 105. In this way, the shoulder straps 35 are removably attachable to the pair of opposing sidewalls 60 via the first pair of complimentary mating fasteners 105 and then attachable to the rear wall 55 via the second pair of complimentary mating fasteners 175. In the depicted embodiment, the second pair of complimentary mating fasteners 175 include the female portion of a side release buckle, such that it can receive the male mating portion disposed on the auxiliary straps 90.

In operation, the collapsible canopy apparatus 10 enables a user to place a backpack in between the rear wall 55 and the waistband 30 and then fasten the auxiliary straps 90 of the shoulder straps 35 to the second pair of complimentary mating fasteners 175. In this way, a user may suspend the collapsible canopy apparatus 10 around a backpack by securing the backpack between the rear wall 55 and the shoulders straps 35, and then utilize the shoulder straps of the backpack to position the canopy 15 around his or her body.

Figure 2:
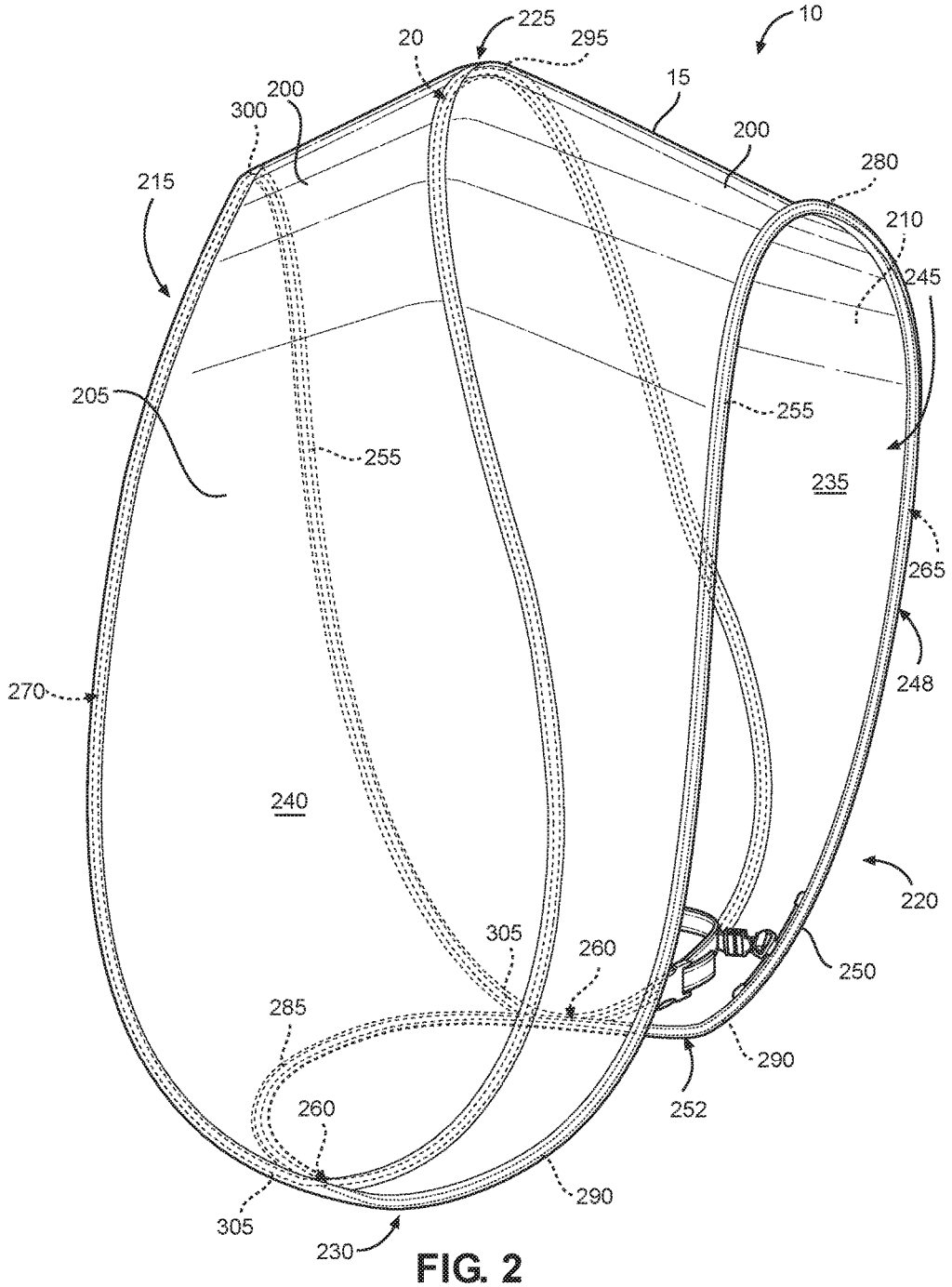
FIG. 2 shows a side perspective view of the collapsible canopy apparatus.

Referring now to FIG. 2, there is shown a side perspective view of the collapsible canopy apparatus. The canopy 15 is disposed about the frame 20 and divided thereabout into one or more side panels 200. In the depicted embodiments, the canopy 15 is illustrated in its biased upright and natural position. The one or more side panels 200 define regions about which the frame 20 may be compressed in order to collapse the canopy 15 into a compressed and folded configuration.

The canopy 15 comprises a body including a first side 205 opposing a second side 210, rear end 215, a front end 220, an arcuate upper end 225, a bottom end 230, an interior surface 235, and an exterior surface 240. The canopy 15 and the frame 20 define the interior volume 40 of the collapsible canopy apparatus 10. The canopy 15 includes an opening 245 extending along a longitudinal face 248 of the front end 220 and a horizontal face 252 of the bottom end 230 that provides access to the interior volume 40. The arcuate structure of the upper end 225 defines a concave inner area in the interior volume 40 of the canopy 15, such that a user's head can fit comfortably therein. The canopy 15 is composed of a lightweight and flexible, water resistant material, such as nylon taffeta, or polyurethane laminate (PUL). In the depicted embodiment, the canopy 15 is fixedly mounted to the frame 20, thereby preventing detachment from the frame 20 in the event of windy weather.

The frame 20 defines a periphery edge 250 extending around the opening 245 of the canopy 15. The frame 20 comprises one or more spring members 255 including curved looped members having arcuate shapes, which give the canopy 15 its upright structure. The one or more spring members 225 include thin unitary elongated members composed of a resilient material, such as spring steel, fiberglass, and rubber, that enable the frame 20 to return to its original shape despite significant deflection, bending, or twisting. The one or more spring members 255 are biased towards an upright position and define the upright structure of the canopy 15. In this way, the canopy 15 may spring back into its upright position from its compressed and folded configuration to ready the canopy 15 for use. The one or more spring members 255 are interconnected at flex points 260, in which the one or more spring members 255 intersect and are configured to fold about, relative to one another.

In the depicted embodiment, the one or more spring members 255 include a first spring member 265 and a second spring member 270 disposed within the body of the canopy 15. The first spring member 265 is defined by a first curved loop including a first arcuate region 280 and a second arcuate region 285 interconnected via a pair of curved regions 290, defining the opening 245 of the canopy 15. The curved regions 290 connect the first and second arcuate regions 280, 285 to one another, such that the first arcuate region 280 is positioned approximately perpendicular relative to the second arcuate region 285. The first arcuate region 280 includes a parabolic shape having an apex that defines, in part, the arcuate upper end 225 of the canopy 15. The first arcuate region 280 extends vertically upwards along the face 248 of the canopy 15 and defines the portion of the periphery edge 250 of the opening 245, which extends about the front end 220 of the canopy 15. The second arcuate region 285 extends horizontally along the bottom end 230 of the canopy 15 and defines the portion of the periphery edge 250 of the opening 245, which extends about the bottom end 230 of the canopy 15.

The second spring member 270 is defined by a second curved loop including a first parabolic region 295 and a second parabolic region 300 that are interconnected by a pair of arcuate regions 305. The first and second parabolic regions 295, 300 each include a symmetrical parabolic shape having an apex that, in conjunction with the first arcuate region 280, defines the arcuate upper end 225 of the canopy 15. The first parabolic region 295 extends vertically along the first and second sides 205, 210 of the canopy 15 and the second parabolic region 300 extends vertically along the rear end 215 of the canopy 15. The pair of arcuate regions 305 are disposed on the first and second sides 205, 210 and adjacent to the bottom end 230 of the canopy 15. The pair of arcuate regions 305 connect the first and second parabolic regions 295, 300 to one another, such that the first and second parabolic regions 295, 300 are aligned and positioned approximately parallel relative to one another.

Figure 3:
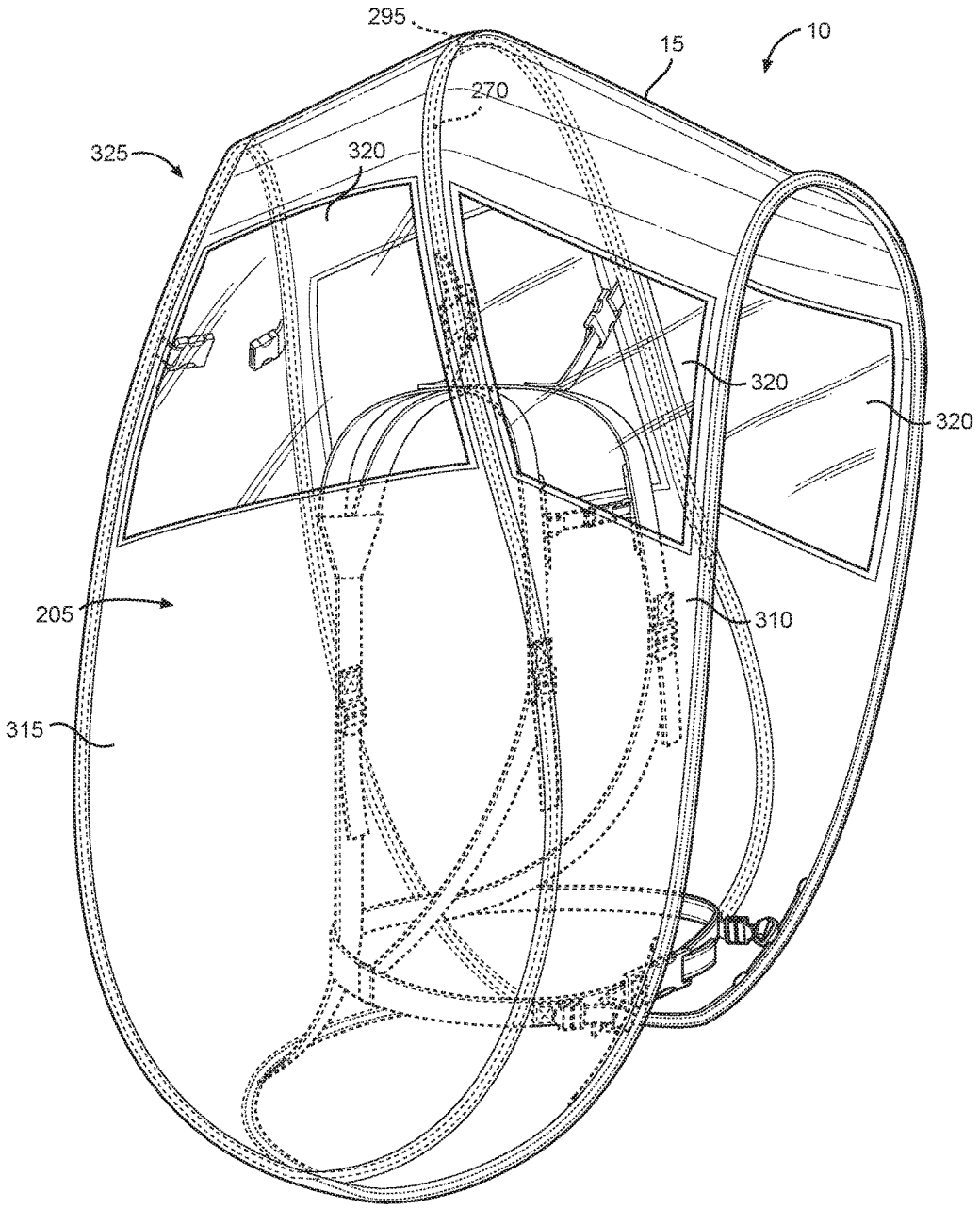
FIG. 3 shows a side view of the collapsible canopy apparatus.

Referring now to FIG. 3, there is shown a side view of the collapsible canopy apparatus according to one embodiment of the present invention. In one embodiment of the collapsible canopy apparatus 10, the canopy 15 includes a first panel 310 and a second panel 315 separated by the second parabolic region 295 of the second spring member 270. The first and second panel 310, 315 extend around the canopy 15 from the bottom end of the first side 205 to the bottom end of the second side 210 of the canopy 15 and include transparent portions 320 for enabling a user to see through the sides 205, 210 of canopy 15 when donned. In this way, a user may see his or her lateral environment when employing the canopy 15. In the depicted embodiment, the transparent portions 320 are disposed on an upper end 325 of the first and second sides 205, 210 of the canopy 15, approximately adjacent to where a user's head would rest inside of the canopy 15 when donned.

Figure 4:
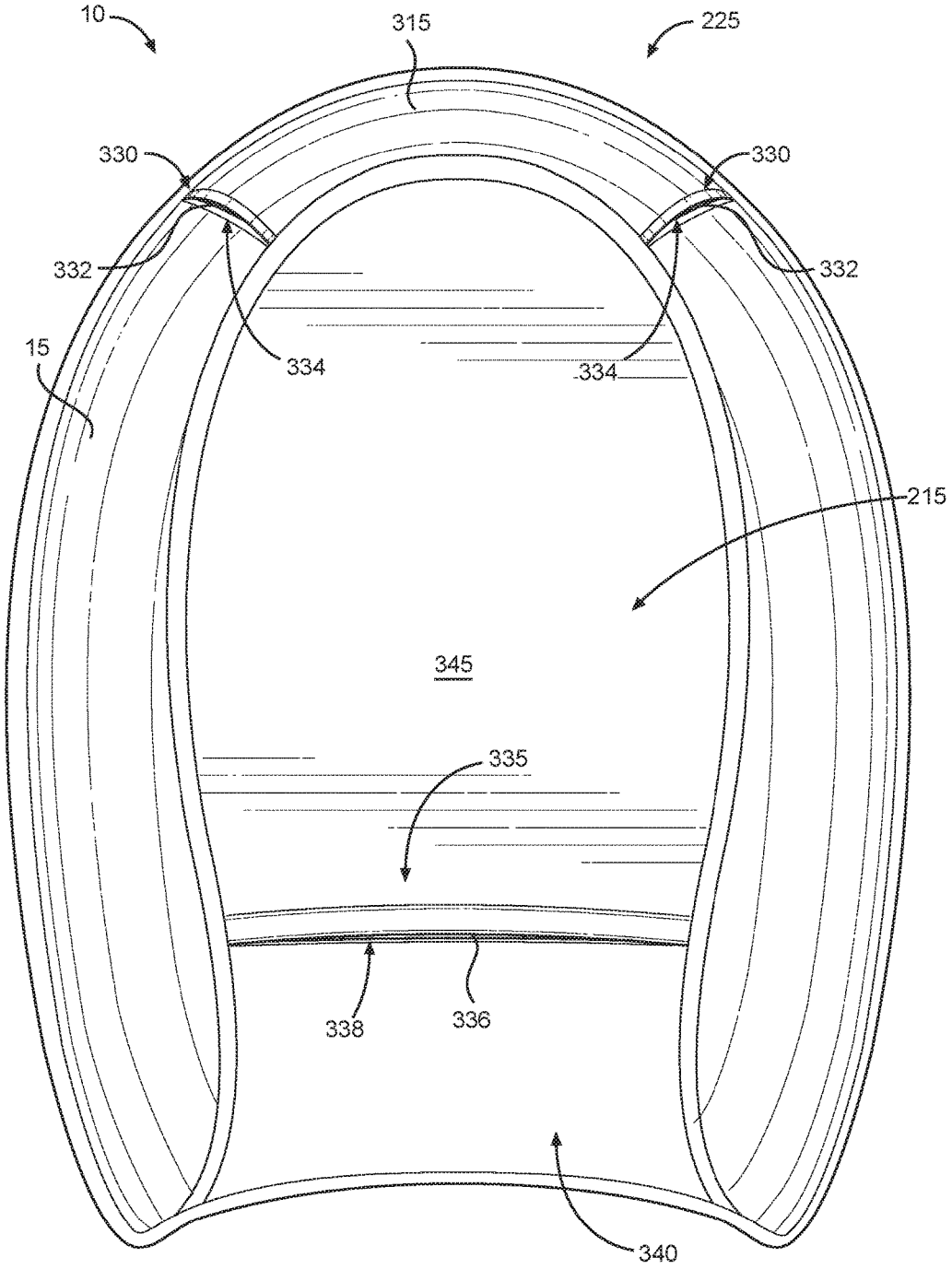
FIG. 4 shows a rear view of the collapsible canopy apparatus.

Referring now to FIG. 4, there is shown a rear view of the collapsible canopy apparatus. In one embodiment of the collapsible canopy apparatus 10, the canopy 15 includes an upper ventilation flap 330 and rear ventilation flap 335. The upper ventilation flap 330 is disposed on the upper end 225 of the canopy 15 and is positioned on the second panel 315 adjacent to the rear end 215 of the canopy. The upper ventilation flap 330 includes a linear slit 332 extending longitudinally along the upper end 225 that defines an opening 334 for providing access to the interior volume of the canopy 15, thereby allowing airflow therein. In the depicted embodiment, the canopy 15 includes a pair of upper ventilation flaps 330. The rear ventilation flap 335 is positioned on a lower portion 340 of the rear end 215 and includes a linear slit 336 extending horizontally or widthwise across a rear surface 345 of the rear end 215. The linear slit 336 defines an opening 338 for providing access to the interior volume of the canopy 15, thereby allowing airflow therein.

Figure 5A:
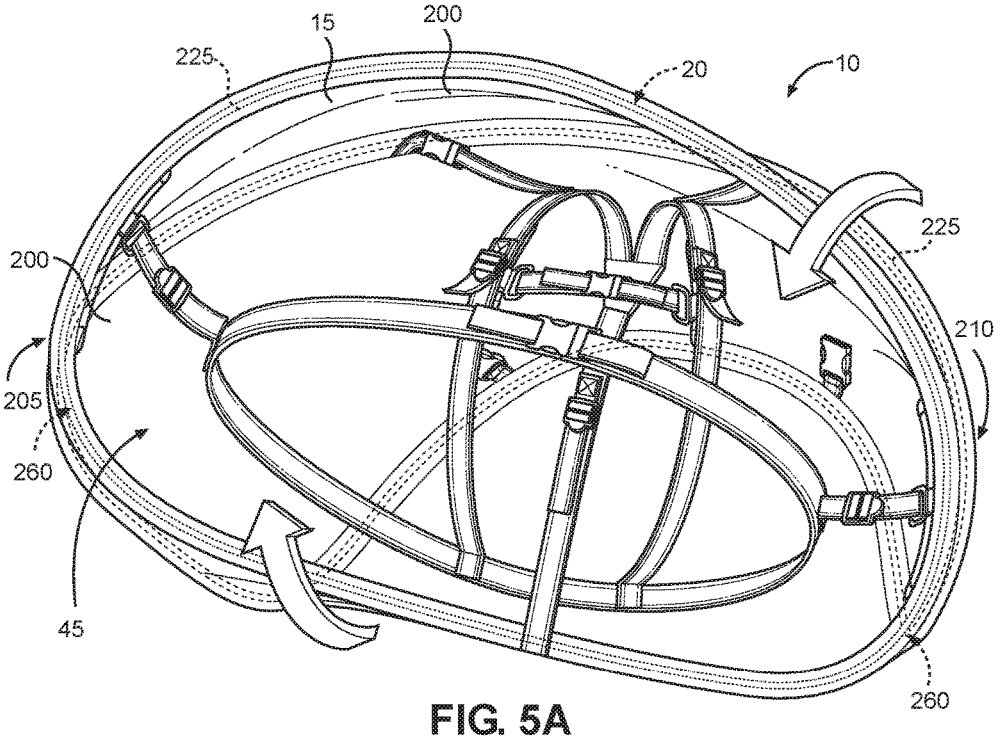
FIG. 5A shows a bottom perspective view of the collapsible canopy apparatus.
Figure 5B:
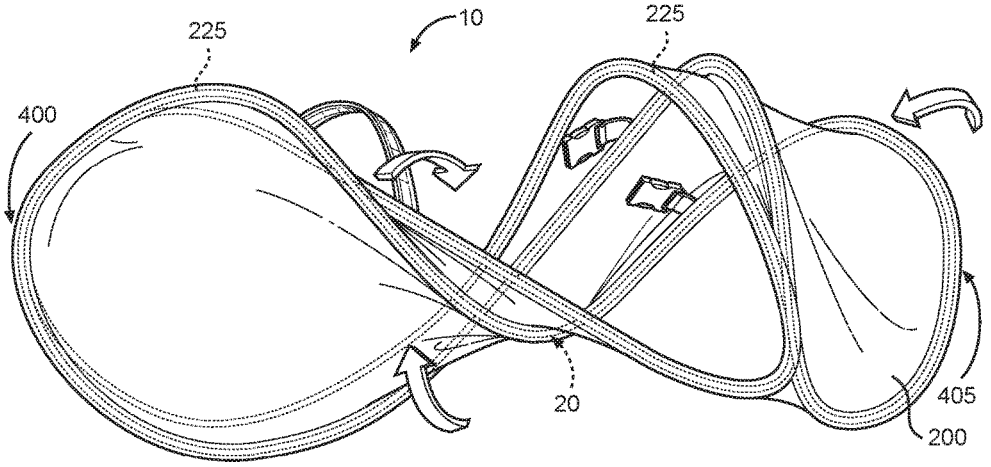
FIG. 5B shows a perspective view the collapsible canopy apparatus in a semi-folded configuration.
Figure 5C:
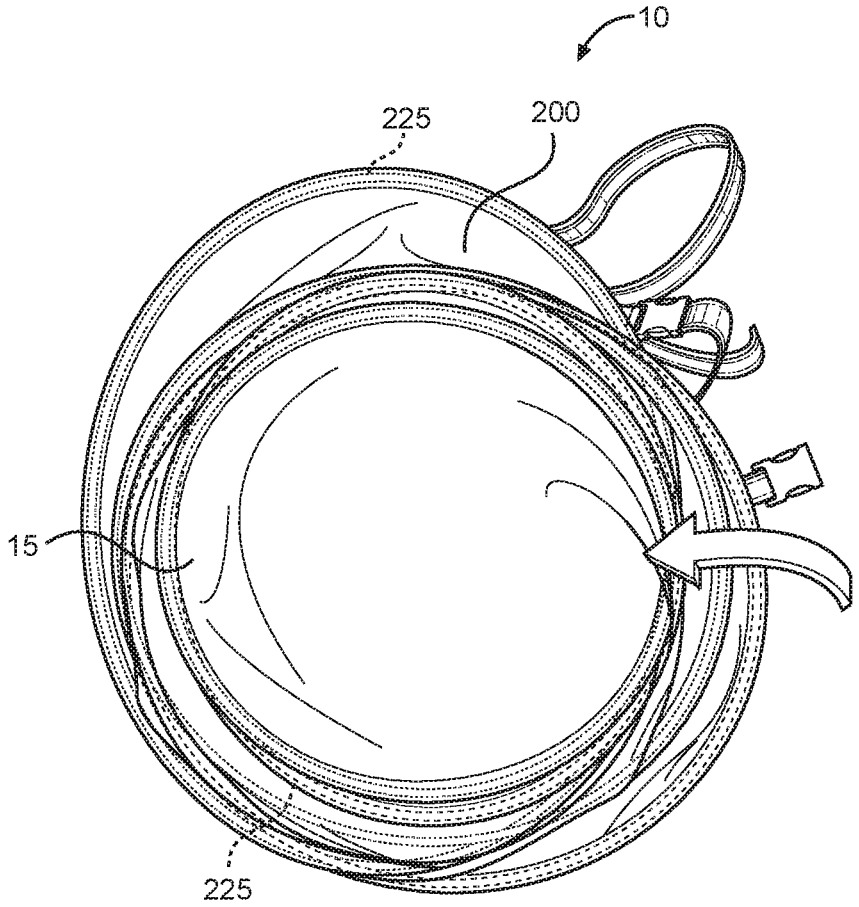
FIG. 5C shows a perspective view of the collapsible canopy apparatus in a folded configuration.

Referring now to FIGS. 5A-5C, there is shown a bottom perspective view of the collapsible canopy apparatus and a view of the collapsible canopy apparatus in a semi-folded and folded configuration, respectively. In its natural position, the one or more spring members 225 of the frame 20 are biased into the positions illustrated in FIGS. 1-4. The flexible quality of the one or more spring members 225 enables the frame 20 to fold and twist into a semi-folded configuration and then a folded configuration, thereby enabling a user to quickly and compactly store the collapsible canopy apparatus 10 when not in use. However, the biased nature of the one or more spring members 225 enables the frame 20 to spring back into its upright structure, automatically from its folded configuration.

The one or more side panels define regions about which the frame 20 may be compressed, while the flex points 260 define regions about which the one or more spring members 225 may twist relative to one another. In operation, to fold the collapsible canopy apparatus 10 into its folded configuration, a user grabs the sides 205, 210 of the canopy 15 at the canopy's 15 lower end 45, such that the canopy 15 is upside down, as shown in FIG. 5A. The user then twists the sides 205, 210 of the canopy 15 in opposite directions.

This twisting action collapses the canopy 15, about its one or more side panels 200, into a figure eight shape, as shown by FIG. 5B. Next, the user folds a first region 400 and a second region 405 of this resulting figure eight-shaped canopy 15 onto one another, such that the first and second regions 400, 405 are approximately concentrically aligned, thereby forming a circular shape, as shown by FIG. 5C. In this shape, the canopy 15 is in its folded configuration, which a user may store compactly in a backpack or carrying case as desired. The backpack or carrying case acts as restraint on the canopy 15 in its folded configuration, thereby preventing it from springing back into its unbiased shape. Hence, if a user desires to unfold and use the canopy 15, the user simply has to isolate the canopy 15 from any form of restraint and allow the one or more spring members 225 to spring back into and acquire their biased shape.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A canopy apparatus, comprising:

a frame including one or more spring members, the one or more spring members biasing the frame in an upright position;

the one or more spring members composed of a flexible and resilient material;

the one or more spring members interconnected at flex points, the one or more spring members intersecting at the flex points and configured to flex thereabout relative to one another into a folded configuration;

a canopy affixed to the frame, the canopy including a first side opposing a second side, a rear end, an open front end having a longitudinal face, an arcuate upper end, an open bottom end having a horizontal face, and an interior volume;

the open front end and the open bottom end conjunctively defining an opening extending vertically along the open front end and horizontally along the open bottom end, the opening configured to provide access to the interior volume through the open front end and through the open bottom end;

a harness including a waistband and shoulder straps, the harness disposed in the interior volume, the interior volume including a lower end, a rear wall, and a pair of opposing sidewalls;

the waistband positioned annularly about the lower end;

the waistband including lateral adjustment straps, the lateral adjustment straps being affixed to the waistband and extending radially outward relative to the waistband towards the pair of opposing sidewalls;

the lateral adjustment straps including slide connectors that are slidably disposed along slide ribs, the slide ribs including elongated rod members protruding from the pair of opposing sidewalls;

wherein the lateral adjustment straps are configured to adjust the proximity of the pair of opposing sidewalls relative to the waistband so as to enable adjustment of the closeness of the pair of opposing sidewalls relative to a user's torso, when the canopy apparatus is donned;

wherein the slide connectors are configured to adjust vertically along the length of the slide ribs so as to enable the user to adjust the height of the waistband relative to the user.

2. The canopy apparatus of claim 1, wherein the one or more spring members are composed of a material selected from the group consisting of spring steel, fiberglass, and rubber.

3. The canopy apparatus of claim 1, wherein the one or more spring members include curved loop members each having a unitary structure and an arcuate region.

4. The canopy apparatus of claim 3, wherein the one or more spring members, comprise:

a first spring member including a first arcuate region and a second arcuate region interconnected by a pair of curved regions, the first arcuate region extending vertically along the longitudinal face and defining a periphery edge about a portion of the opening that extends along the open front end, the second arcuate region extending horizontally along the horizontal face and defining a periphery edge about a portion of the opening that extends along the open bottom end;

the first and second arcuate regions including a parabolic shape, the first arcuate region extending vertically along the open front end, the second arcuate region extending horizontally along the open bottom end;

a second spring member including a first parabolic region and a second parabolic region interconnected by a pair of arcuate regions, the first parabolic region extending vertically along the first side and the second side, the second parabolic region extending vertically along the rear end, the pair of arcuate regions disposed on the first side and second side adjacent to the bottom end;

wherein the first parabolic region and the second parabolic region are aligned and positioned parallel to one another;

wherein the first arcuate region and the first and second parabolic regions define the arcuate upper end of the canopy.

5. The canopy of apparatus of claim 1, wherein the canopy is composed of a lightweight and flexible water resistant material.

6. The canopy apparatus of claim 1, wherein the waistband includes a unitary strap including a fastener for removably mounting the waistband around the user's waist.

7. The canopy apparatus of claim 6, wherein the waistband comprises a first end including a male mating portion of a side release buckle and a second end including the female mating portion of a side release buckle, the male mating portion and the female mating portion conjunctively forming the fastener.

8. The canopy apparatus of claim 1, wherein the shoulder straps include auxiliary straps configured to interchangeably attach the shoulder straps to the opposing sidewalls and the rear wall in order to selectively suspend the shoulder straps from the opposing sidewalls or the rear wall.

9. The canopy apparatus of claim 8, wherein the auxiliary straps extend outwardly from the shoulder straps, each auxiliary strap including a mating fastener disposed at a distal end thereof, wherein the mating fastener is configured to attach to a first complementary mating fastener disposed on the opposing sidewalls, the mating fastener comprising a male mating portion of a side release buckle and the first complementary mating fastener comprising a female mating portion of a side release buckle, the mating fastener and the first complementary mating fastener conjunctively forming a side release buckle.

10. The canopy apparatus of claim 9, further comprising a second complementary mating fastener disposed on the rear wall of the interior volume of the canopy, the second complementary mating fastener configured to receive a mating fastener of the auxiliary straps so as to enable the user to secure a backpack in between the rear wall and the waistband and then fasten the auxiliary straps of the shoulder straps to the second complimentary mating fasteners.

11. The canopy apparatus of claim 10, wherein the second complementary mating fastener comprises a female mating portion of a side release buckle.

12. The canopy apparatus of claim 1, further comprising a support member extending from the shoulder straps to a perimeter edge of the lower end, the support member including a strap adjuster for adjusting the height of the shoulder straps relative to the lower end.

13. The canopy apparatus of claim 1, wherein the shoulder straps include a cross strap including a fastener for removably securing the shoulder straps to one another, the cross strap slidably disposed on the shoulder straps via a pair of slide ribs extending longitudinally along the shoulder straps.

14. The canopy apparatus of claim 13, wherein the cross strap includes a first portion having a male fastener and a second portion having a complementary female fastener.

15. The canopy apparatus of claim 14, wherein the male fastener comprises a male portion of a side release buckle and the complementary female fastener comprises a female portion of the side release buckle, the male fastener and the female fastener conjunctively forming a side release buckle.

16. The canopy apparatus of claim 1, comprising one or more transparent portions disposed on the first side and second side of the canopy.

17. The canopy apparatus of claim 1, comprising an upper ventilation flap disposed on the arcuate upper end of the canopy and a rear ventilation flap disposed on the rear end of the canopy.

* * * * *